United States Patent [19]

Tischer

[11] Patent Number: 4,662,190

[45] Date of Patent: May 5, 1987

[54] INTEGRAL SLIDE VALVE-OIL SEPARATOR APPARATUS IN A SCREW COMPRESSOR

[76] Inventor: James C. Tischer, c/o The Trane Company, La Crosse, Wis. 54601

[21] Appl. No.: 807,406

[22] Filed: Dec. 10, 1985

[51] Int. Cl.[4] ..... F25B 43/02

[52] U.S. Cl. ..... 62/470; 62/84

[58] Field of Search ..... 62/84, 468, 470

[56] References Cited

U.S. PATENT DOCUMENTS

| | | | |
|---|---|---|---|
| 3,200,603 | 8/1965 | Wake et al. | 62/470 |
| 3,408,828 | 11/1968 | Soumerai et al. | 62/470 |
| 4,335,582 | 6/1982 | Shaw et al. | 62/196 |
| 4,478,054 | 10/1984 | Shaw et al. | 62/323 |

*Primary Examiner*—Ronald C. Capossela

[57] ABSTRACT

The slide valve assembly by which the capacity of an oil-injected screw compressor is controlled includes a valve portion connected to a piston. The valve portion is located in the screw rotor housing while the valve actuating piston is located within a pressure housing interior of a centrifugal oil separator in what would otherwise be unused space. The rod connecting the valve portion and piston penetrates the discharge port of the compressor. The piston is actuated and the compressor is loaded by directing separated oil from the oil sump in a sealed sump housing into the pressure chamber within the centrifugal oil separator. The oil separator is located within the sealed oil sump housing. Oil is vented from the pressure housing into a suction area within the rotor housing to unload the compressor. Such oil is sucked into the working chamber of the compressor where it assists in the cooling, lubricating and sealing of compressor components.

20 Claims, 2 Drawing Figures

INTEGRAL SLIDE VALVE-OIL SEPARATOR APPARATUS IN A SCREW COMPRESSOR

DESCRIPTION

This patent is related to U.S. patent application Ser. No. 692,096, to the assignee of the present invention.

BACKGROUND OF THE INVENTION

The present invention relates generally to the art of compressing a gas. More particularly, the present invention relates to the compression of a refrigerant gas. Further, the present invention relates to the compression of a refrigerant gas in an oil-injected rotary screw compressor. With still more particularity, the present invention relates to apparatus in an oil-injected screw compressor for varying the capacity of the compressor and for separating oil from the refrigerant gas-oil mixture discharged from the compressor. Finally, the present invention relates to a slide valve assembly the actuating portion of which is integral with an oil separator located downstream of the discharge port in an oil-injected screw compressor.

Compressors are used in refrigeration systems to raise the pressure of a refrigerant gas from a suction to a discharge pressure which permits the ultimate use of the refrigerant to cool a desired medium. Many types of compressors, including rotary screw compressors, are commonly employed to compress refrigerant gas in refrigeration systems. Two complementary screw rotors, a male and a female, are located within a working chamber within the housing of a screw compressor. The working chamber can be characterized as a volume generally in the shape of two parallel intersecting cylindrical bores closely toleranced to the pair of meshed male and female screw rotors disposed therein. The screw compressor housing has low and high pressure ends defining suction and discharge ports respectively. Refrigerant gas at suction pressure enters the compressor suction port at the low pressure end of the compressor housing and is there enveloped in a pocket formed between the rotating complementary screw rotors. The volume of the gas pocket decreases and the pocket is displaced to the high pressure end of the compressor as the rotors rotate and mesh within the working chamber. The gas within such a pocket is compressed, and therefore heated, by virtue of the decreasing volume in which it is contained, prior to the pocket's opening to the discharge port at the high pressure end of the compressor. The pocket, as it continues to decrease in volume, eventually opens to the compressor discharge port at which point the compressed gas is discharged from the working chamber of the compressor.

One advantage of rotary screw compressors resides in the ability to easily modulate their capacity and therefore the capacity of the system in which the screw compressor is employed. Such capacity variance is normally accomplished through the use of a slide valve assembly. The valve portion of the slide valve assembly is built into and forms an integral part of the rotor housing of a screw compressor. Surfaces of the valve portion of the slide valve assembly generally cooperate with the remainder of the compressor's rotor housing to define the working chamber within the compressor. The slide valve is axially movable to expose a portion of the working chamber of the compressor, downstream of the suction port and which is not normally exposed to suction pressure, to a location within the compressor, other than at the suction port, which is at suction pressure. The portion of the working chamber initially opened to suction pressure by movement of the slide valve is that portion immediately downstream of the point at which compression of the refrigerant gas would normally begin within the working chamber. As the slide valve is opened further, a greater portion of the working chamber and the screw rotors therein are exposed to suction pressure. Capacity reduction is obtained by effectively reducing the portion of each rotor used for compression. When the slide valve is closed the compressor is fully loaded and operates at full capacity to compress refrigerant gas. When the slide valve is fully open, that is, when the portion of the screw rotors axially exposed to suction pressure other than at the suction port is greatest, the compressor is unloaded to the maximum extent possible. Positioning of the valve between the extremes of the full load and unload positions is accomplished without difficulty with the result that the capacity of a screw compressor, and the system in which it is employed, is modulated smoothly and efficiently over a large operating range. The slide valve is most often hydraulically operated.

Screw compressors used in refrigeration applications will, in the large majority of instances, include an oil-injection feature. Oil is injected into the working chamber of the compressor, and therefore into the refrigerant gas being compressed between the rotors therein, for several reasons. First, the oil injected into the working chamber acts as a sealant between the meshing screw rotors and between the rotors and the surface of the working chamber in which the rotors are disposed. Second, the oil acts as a lubricant. One of the two rotors in the screw compressor is normally driven by an external source, such as an electric motor, while the other rotor is driven by virtue of its meshing relationship with the externally driven rotor. The injected oil prevents excessive wear between the driving and driven rotors. Finally, in some applications, oil which has been cooled to increase its viscosity and its ability to act as a sealant is injected into the working chamber to cool the refrigerant undergoing compression therein which in turn allows for tighter rotor clearances at the outset.

Oil injected into the working chamber of a screw compressor is atomized and becomes entrained in the refrigerant gas undergoing compression therein. Such oil, to a great extent, must be removed from the oil-rich mixture discharged from the compressor in order to make the oil available for, among other things, reinjection into the compressor for the purposes enumerated above. Further, removal of excess injected oil must be accomplished to insure that the performance of the refrigerant gas is not unduly affected within the refrigeration circuit.

Previously, oil separation and slide valve actuation schemes have essentially been both structurally and functionally unrelated within screw compressor assemblies. Such disassociation has resulted in relatively complex and dedicated slide valve apparatus entirely separate from the oil separation apparatus within screw compressors. At worst, the two functions and their related structure are entirely disassociated within a compressor assembly. At best, the functions are only peripherally related within a compressor assembly. The former is illustrated by U.S. Pat. No. 4,335,582 while the latter is illustrated by U.S. Pat. No. 4,478,054. The disassociation of such apparatus within screw compressors exists despite the fact that in most instances both apparatus relate directly to the processing and use of oil within the screw compressor assembly. Whereas the separator functions to separate oil from the refrigerant gas-oil mixture discharged from the compressor in order to allow the oil to be reused, the slide valve assembly, in most instances, is actuated by such oil. Clearly, it would be advantageous to combine the slide valve assembly/oil separator functions to the extent possible within a screw compressor assembly to eliminate unnecessary duplication of structure, expense and weight. Until the apparatus of the present invention was conceived, no integral slide valve assembly-oil separation scheme for screw compressors was known to exist.

SUMMARY OF THE INVENTION

It is an object of this invention to provide integral oil separation and compressor capacity control apparatus in an oil-injected rotary screw compressor assembly.

It is a further object of this invention to provide such apparatus in a manner eliminating unnecessary duplication of structure and weight in a screw compressor assembly.

It is another object of this invention to provide such apparatus while further providing for a short, clean flow path for the mixture of oil and compressed gas discharged by an oil-injected screw compressor to, through and out of the oil separator in a screw compressor assembly so as to minimize pressure drop in the compressed gas.

Additionally, it is an object of this invention to provide a centrifugal oil separator for a screw compressor assembly in which the piston which actuates the compressor slide valve is located within the oil separator and is actuated by oil separated from the mixture discharged by the compressor.

These and other objects of the invention will become apparent upon reading the summary of the invention, the detailed description thereof and the claims which follow.

The present invention provides for integral slide valve-oil separator apparatus in a screw compressor assembly in which the valve portion of the slide valve is disposed in the compressor portion of the assembly while the slide valve actuating apparatus is disposed in the oil separator portion of the assembly in what would otherwise be unused space therein. The oil separator portion of the present invention includes a cylindrically-shaped centrifugal oil separator in which a helical ramp is disposed around an inner cylinder. The ramp and inner cylinder are located within a permeable outer housing. Disposed within the inner cylinder of the oil separator is a pressure housing which defines a pressure chamber in which the piston portion of the slide valve assembly is disposed. The permeable housing is located within a sealed oil sump housing attached to the rotor housing portion of the compressor assembly. A connecting rod rigidly connects the slide valve actuator piston disposed within the oil separator portion with the valve portion of the slide valve assembly located within the rotor housing portion of the compressor assembly. The connecting rod penetrates the discharge port of the rotor housing. Oil at discharge pressure pools in the oil sump housing subsequent to being separated from the mixture discharged from the rotor housing and is selectively admitted to the pressure chamber within the oil separator to move the slide valve piston within the pressure chamber. As a result of such piston movement, the valve portion of the slide valve assembly is moved axially within the compressor housing to increase the degree to which the compressor is loaded. Oil vented from the pressure chamber within the oil separator is directed to an area within the compressor portion of the assembly which is at suction pressure. Such venting results in the movement of the slide valve, under the impetus of compressor discharge pressure, toward the position in which the compressor assembly is unloaded.

DESCRIPTION OF THE PREFERRED EMBODIMENT

Figure 1:
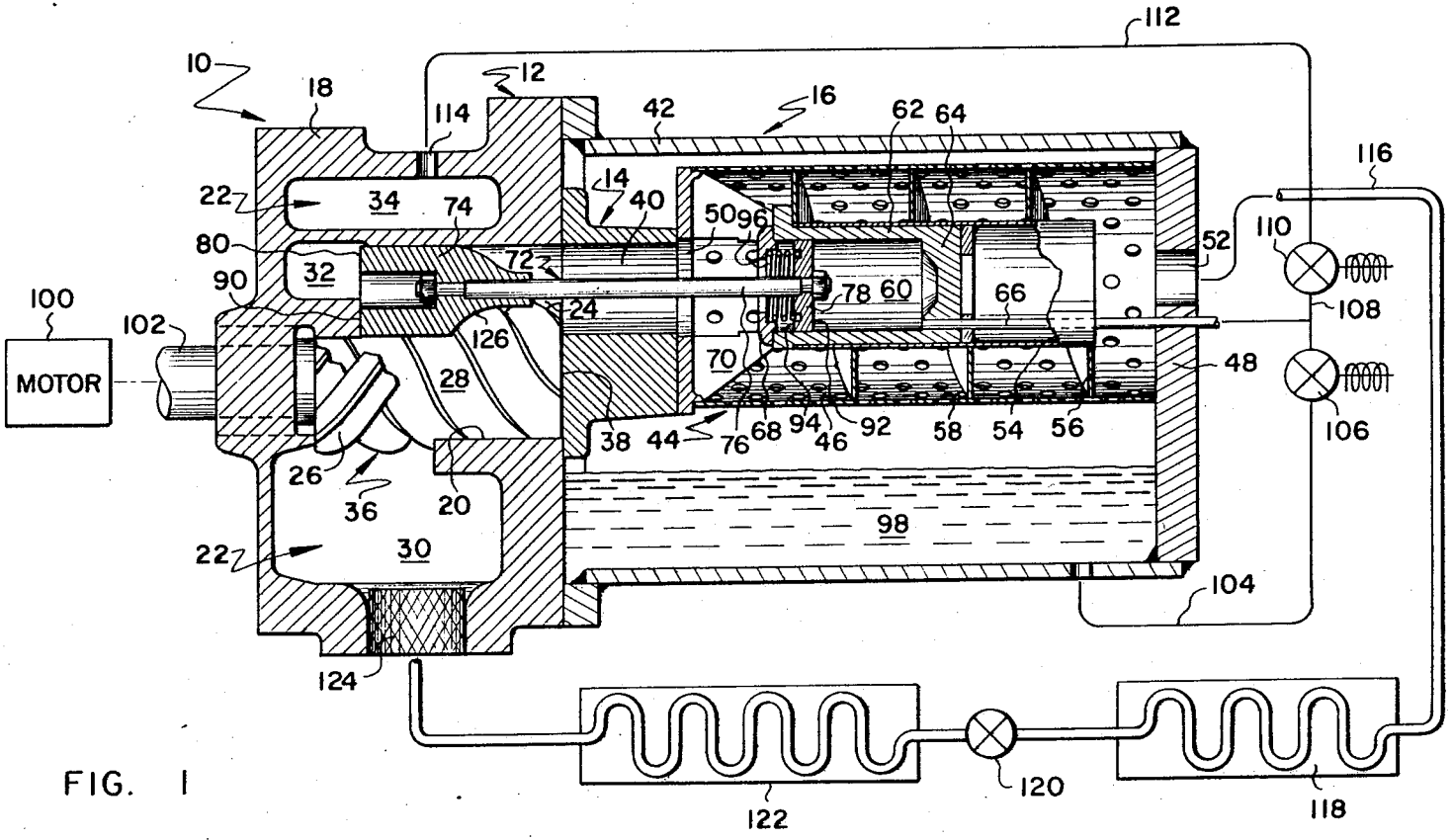
FIG. 1 is a schematic view of a screw compressor refrigeration system showing the compressor in cross section and as its components are positioned when the compressor is fully loaded.

Referring to the Figures, screw compressor assembly 10 includes a compressor portion 12, a bearing housing portion 14 and an oil separator portion 16. Compressor portion 12 includes a rotor housing 18 which defines a working chamber 20, a suction portion 22 and a discharge port 24. Working chamber 20 is a volume configured generally as two parallel, axially running, intersecting cylindrical bores within rotor housing 18. Helical screw rotors 26 and 28 are disposed in a meshing relationship within working chamber 20 which is closely toleranced to the outside length and diameter dimensions of the rotors. Rotor 26, in the preferred embodiment, is a female rotor while rotor 28 is a male rotor. Suction portion 22 of rotor housing 18 inqludes suction inlet area 30 and suction areas 32 and 34, all of which are in flow communication and at suction pressure when the compressor assembly is in operation. A suction screen is disposed within suction inlet 30 to prevent matter of any size greater than a predetermined mesh size from being admitted to suction portion 22 of compressor portion 12. Screw rotors 26 and 28 cooperate with rotor housing 18 of compressor portion 12 in suction area 30 to define a suction port 36. Rotors 26 and 28 and rotor housing 18 likewise cooperate to define discharge port 24. Discharge port 24 is an irregularly shaped area located between and above the rotors at the high pressure end of rotor housing 12. The shape and volume of discharge port 24 will vary depending upon the the position of slide valve assembly 72 which will later be discussed.

Bearing housing 14 is disposed at the high pressure end of rotor housing 18 and includes a bearing surface 38. Housing 14 also defines a discharge passage 40. Mounted within bearing housing 14 are the bearings, not shown, in which the shafts extending from the high pressure ends of screw rotors 26 and 28 rotate. Discharge passage 40 of bearing housing 14 is in flow communication with discharge port 24 defined by rotors 26 and 28 and rotor housing 18 in compressor portion 12.

Oil separator portion 16 of compressor assembly 10 includes a sealed oil sump housing 42 disposed around centrifugal oil separator 44 and attached to rotor housing portion 18. Centrifugal oil separator 44 has a permeable outer housing 46 and is disposed within sump housing 42. Separator 44 defines an inlet 50 in flow communication with discharge passage 40 while end wall 48 of sump housing 42 defines an outlet 52. Disposed within oil separator 44 is inner cylindrical housing 54. Inner cylindrical housing 54 is preferably concentric within permeable outer housing 46 and is mounted within a helical ramp structure 56, the outer edges of which abut inner surface 58 of permeable housing 46. A pressure chamber 60 is defined, in part, by pressure housing 62 which is disposed within inner cylindrical housing 54 of oil separator 44. Pressure housing 62 includes a base portion 64 penetrated by conduit 66 which connects chamber 60 with oil conduit as will later be described. Pressure housing 62 is capped at the end opposite base portion 64 by end cap 68 which defines an opening through which the interior of housing 62 communicates with inlet 50. It will be apparent that inner housing 54 and pressure housing 62 might be combined as a single unitary housing element. Ribs 70 act as structural support for end cap 68 and housing 62 within the oil separator portion. Permeable housing 46, inner cylindrical housing 54, helical ramp 56 and end wall 48 of oil separator portion 16 all cooperate to define a helical passage between inlet 50 of separator 44 and outlet 52 in end wall 48 of oil sump housing 42. For ease of manufacture separator 44 will preferably abut but not be connected to end wall 48 of sump housing 42.

Figure 2:
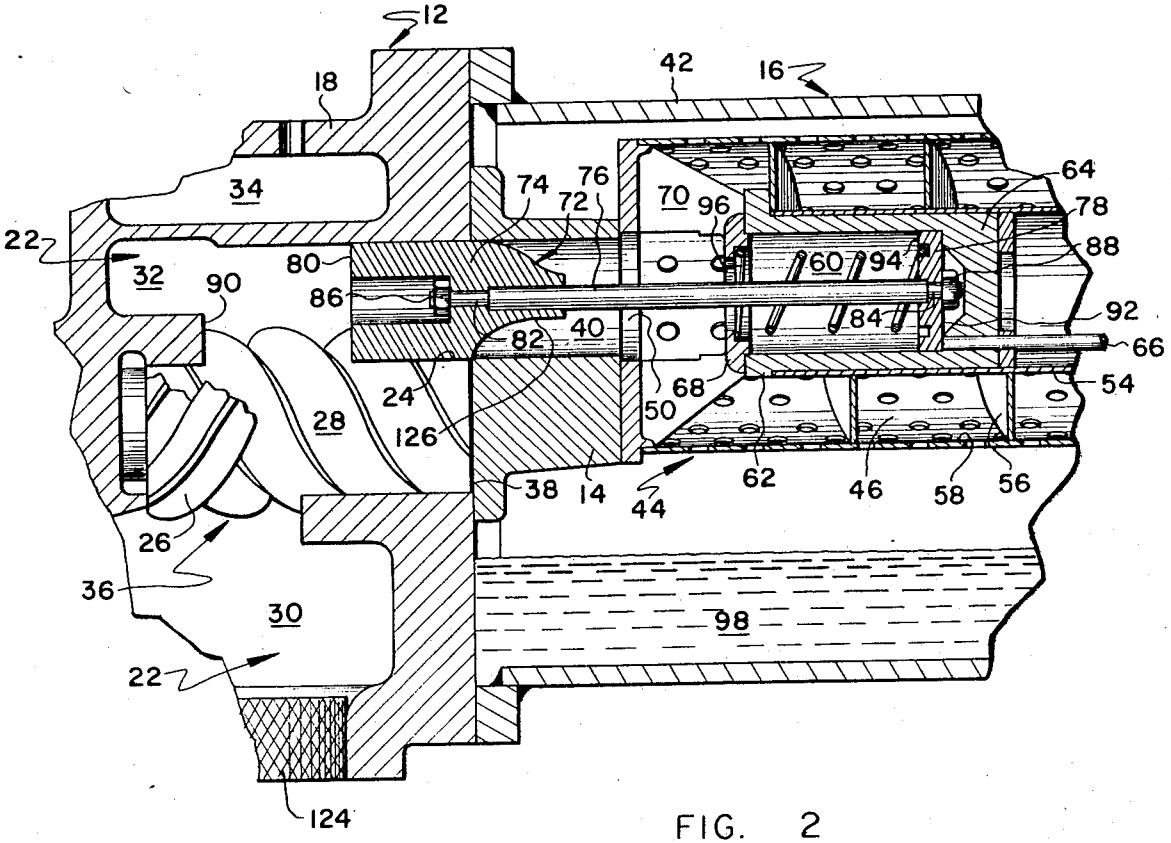
FIG. 2 is a partial view of the compressor of FIG. 1 but with compressor components positioned as when the compressor is unloaded.

As seen more readily in FIG. 2, slide valve assembly 72 includes valve portion 74, connecting rod portion 76 and piston 78. Piston 78 is sealingly disposed for axial movement within pressure chamber 60 of pressure housing 62 within oil separator 44. Valve portion 74 of slide valve assembly 72 is disposed in rotor housing portion 18 of compressor assembly 12 and cooperates with rotor housing 18 and bearing surface 38 of bearing housing 14 in the definition of working chamber 20. Valve portion 74 includes low pressure end face 80 which is preferably a flat surface. Connecting rod portion 76 of the slide valve assembly rigidly connects piston 78 and valve portion 74 such that axial movement of piston 78 within pressure chamber 60 causes corresponding axial movement of valve portion 74 with respect to rotors 26 and 28 within rotor housing 18. As illustrated, connecting rod portion 76 includes reduced diameter threaded end sections 82 and 84 which penetrate both piston 78 and valve portion 74, respectively. Nuts 86 and 88 rigidly secure the three valve assembly portions to each other. Connecting rod 76 penetrates discharge port 24 of rotor housing 18, passes through discharge passage 40 of bearing housing 14 and penetrates both inlet 50 and the opening defined by end cap 68 of oil separator portion 16.

Piston 78 is movable within pressure housing 62 between a first position as illustrated in FIG. 1 and a second position as illustrated in FIG. 2. When piston 78 is in the position within pressure housing 62 illustrated in FIG. 1, low pressure end face 80 of valve portion 74 of the slide valve assembly abuts stop 90 which is a structural portion of rotor housing 18. In the position in which valve portion 74 of the slide valve assembly abuts stop 90, compressor assembly 10 is fully loaded, that is, only the portion of rotors 26 and 28 which cooperate in defining suction port 36 in suction area 30 are exposed to suction pressure within rotor housing 18. When piston 78 is in the position within pressure housing 62 illustrated in FIG. 2, valve portion 74 of slide valve assembly is moved away from stop 90 in rotor housing 18 to expose a portion of screw rotors 26 and 28, other than that portion which cooperates with the rotor housing to define suction port 36, to suction pressure within rotor housing 18. In the preferred embodiment, movement of valve portion 74 away from stop 90 exposes screw rotors 26 and 28 to suction pressure in suction area 32 of rotor housing 18. The position of slide valve assembly 72 illustrated in FIG. 2 is the position in which compressor assembly 10 is operating unloaded. Slide valve assembly 72 is movable within compressor assembly 10 between the full load position illustrated in FIG. 1 and the unload position of FIG. 2 and is further capable of being maintained at part-load positions anywhere in between the positions illustrated in FIGS. 1 and 2.

When valve assembly 72 is in the full load position of FIG. 1 refrigerant gas entering suction port 36 begins to undergo compression as soon as suction port 36 closes. Suction port 36 closes as the meshing of rotors 26 and 28 proceeds to the extent that a volume is formed within working chamber 20 which is not exposed to suction area 30 of rotor housing 18. Such volumes are chevron shaped and are generally defined by the closed, meshed screw rotors and the wall surface of working chamber 20 within which the rotors are disposed. As valve portion 74 of slide valve assembly 72 is moved away from stop 90 of rotor housing 18 toward the position of FIG. 2, an increasing portion of screw rotors 26 and 28 is exposed to suction pressure within suction area 32 of rotor housing 18. The effect of this movement is to delay the point at which the compression of gas sucked into the meshing rotors through suction port 36 begins to occur within the compressor assembly, irrespective of the fact that suction port 36 has closed with respect to a particular chevron-shaped volume. Thus, the movement of valve portion 74 away from stop 90 exposes a portion of what would otherwise be a closed off chevron-shaped volume between rotors 26 and 28 within working chamber 20 to suction pressure, although in suction area 32 of suction portion 22, as opposed to in suction area 30. The net effect of the movement of valve portion 74 away from stop 90 is to effectively shorten the length of rotors 26 and 28 and to decrease the volume of gas being compressed. Therefore, the capacity of compressor assembly 10 is reduced. It should be clear that the farther low pressure end surface 80 of slide valve portion 74 is moved away from stop 90 of rotor housing 18, the more rotors 26 and 28 are exposed to suction pressure and the less is the initial volume of gas available for compression as the screw rotors mesh within working chamber 20.

Movement of piston 78 within pressure housing 62 is achieved by the selective admission of pressure fluid to and venting of such fluid from pressure chamber 60. Chamber 60 is defined by pressure housing 62 and interior surface 92 of piston 78. Piston movement is further affected by the exposure of exterior surface 94 of piston 78 to compressor discharge pressure as communicated from compressor discharge port 24 in rotor housing 18, through discharge passage 40 in bearing housing 14 and through inlet 50 of oil separator portion 16. The size of the area of exterior surface 94 of piston 78 is larger than the axially projected area of high pressure end face 126 of valve portion 74 which is exposed to discharge pressure. As a result, when all other forces acting on slide valve assembly 92 are ignored, the slide valve assembly is biased by discharge pressure to the unload position within compressor assembly 10, as illustrated in FIG. 2. Biasing means, such as spring 96 disposed between end cap 68 and piston 78, may be employed to ensure a positive bias of the slide valve assembly toward the unload position. Such biasing means are particularly useful in ensuring that the slide valve assembly is returned to the unload position when chamber 60 is vented whether due to a mechanical malfunction or at compressor shutdown and remains in that position until the compressor is next started.

Since housing 46 of oil separator 44 is permeable, the volume interior of sealed oil sump housing 42, including oil in sump area 98, is exposed to and maintained essentially at compressor discharge pressure when compressor portion 12 is in operation. Compressor portion 12 is in operation when the driven rotor of rotors 26 and 28 is rotated by a driving means such as motor 100. Motor 100 drives shaft 102 upon which the driven rotor of rotors 26 and 28 is mounted for rotation. In the preferred embodiment, male rotor 28 is the driven rotor. As mentioned previously, oil is employed for several purposes within compressor assembly 10. One purpose is to lubricate and cool the screw rotors within working chamber 20. Therefore, oil at discharge pressure in sump 98 is directed out of sump 98 and is injected into working chamber 20 under the impetus of the pressure differential which exists between the interior of sump housing 98 and the point of oil injection into the working chamber 20 within rotor housing 18. The passage through which oil is injected into working chamber 20 of rotor housing 18 is not shown but, in the preferred embodiment, is a passage which leads from sump 98 to an inlet disposed over female rotor 28 in the upper portion of the working chamber. Another purpose for which oil in sump 98 is used is to actuate slide valve assembly 72.

Oil for actuating slide valve assembly 72 is directed from sump 98 through conduit section 104, first solenoid valve 106 and tee-section 108 into pressure conduit 66 within oil separator portion 16. Oil at discharge pressure entering conduit 104 is directed into pressure chamber 60 and acts on interior surface 92 of piston 78 to bias the slide valve assembly to the full load position of FIG. 1 in which low pressure end face 80 of valve portion 74 is forced to abut stop 90 of rotor housing 18. It will be remembered that in operation discharge pressure acts both on exterior surface 94 of piston 78 and on high pressure end face 126 of valve portion 74. As a result, the net axial force on slide valve assembly 72 resulting from the discharge of the mixture of compressed refrigerant gas and oil produced in compressor portion 12 is not significant as compared to the force brought to bear on slide valve assembly 72 by the admission of oil at discharge pressure to chamber 60. When solenoid 110 is opened while solenoid 106 is closed, so as to unload compressor portion 12, both compressor discharge pressure and the force of spring 96 act on surface 94 of piston 78 to force oil out of pressure chamber 60. Such oil passes through conduit 66, tee-section 108, and second solenoid 110, prior to entering conduit section 112. Conduit section 112 opens into suction portion 22 of compressor portion 12 such as through passage 114 which communicates with suction area 34 of suction portion 22. Oil vented from chamber 60 into suction portion 12 of rotor housing 18 is drawn, along with suction gas entering suction inlet area 30, into suction port 36 and therefore assists the oil injected directly into working chamber 20 in the cooling, sealing and lubricating of the screw rotors. It will be noted that suction pressure does act on low pressure end face 80 of valve assembly 72 and is therefore a factor in the movement of the valve assembly.

First solenoid valve 106 and second solenoid valve 110 are controlled such that when the load on the refrigeration system in which compressor assembly 10 is employed increases, first solenoid valve 106 is pulsed open to cause slide valve assembly 72 to move toward the full load position of FIG. 1. When a decrease in system load is sensed, second solenoid 110 is pulsed open to vent pressure chamber 60 to suction portion 22. At constant load conditions first and second solenoids 106 and 110 are closed and pressure chamber 60, pressure conduit 66 and tee-section 108 are filled with oil at discharge pressure. Piston 78 and valve portion 74 will thus be hydraulically locked in a static position at or between full load and unload positions when both solenoids are closed. Valve portion 74 is thus positionable between the extremes of the full load and unload positions simply by selectively pulsing the appropriate solenoid valve to admit or vent pressure fluid to or from pressure housing 62. The control of solenoids 106 and 110 and the system parameters to which their controls respond is not the subject of the present invention.

At compressor startup, slide valve assembly 72 is in the unload position illustrated in FIG. 2 since chamber 60 is vented to suction upon compressor shutdown. High pressure end face 126 of slide valve 72 is contoured and the shape of discharge port 24 is such that in the unload position illustrated in FIG. 2 the compression and discharge of gas from compressor portion 12 will continue to occur when the rotors rotate, although compressor capacity will be extremely low, i.e., approximately 10%. The initial volume of refrigerant gas discharged from compressor portion 12 after startup acts immediately to pressurize the interior of oil sump housing 42 which in turn provides the oil necessary for slide valve actuation and causes oil to immediately be injected into working chamber 20 of rotor housing 18 as well.

The mixture of refrigerant gas and oil discharged from compressor portion 12 passes through discharge passage 40 of bearing assembly 14 and enters inlet 50 of oil separator portion 16. It will be noted that the flow path of the mixture discharged from the compressor to separator portion 16 is short, straight and clean thereby minimizing pressure drop in the mixture which is of significant importance in refrigeration applications. The same can be said of the flow path of the mixture through and out of separator 44. The mixture is forced to follow the helical passage defined by ramp 56 within separator 44 and is thereby imparted a swirling motion. The oil entrained within the mixture, being heavier than the refrigerant gas portion of the mixture, is centrifugally forced to migrate radially outward and toward permeable housing 46. Such oil passes through permeable housing 46 and settles by force of gravity within sump 98 of sealed oil sump housing 42 while the compressed gas from which the oil has been separated continues to travel essentially unidirectionally through separator 44 and out of sump housing 42 through outlet 52. The oil is then employed in compressor assembly 10 for the purposes previously enumerated. It is to be noted that permeable, as defined in WEBSTER'S NEW COLLEGIATE DICTIONARY, copyright 1975 by G. & C. Merriam Company, is defined as "having pores or openings that permit liquids or gases to pass through". As such, the structure of housing 46 may be meshlike, may define a plurality of discrete openings or may be of any manufacture which permits the through passage of liquid while presenting enough of a barrier to gas flow so as to contain and channel such flow within oil separator portion 16 between inlet 50 and outlet 52. Refrigerant gas, at discharge pressure and from which oil has been separated, exits outlet 52, passes through end wall 48 of oil separator portion 16 and is directed into discharge conduit 116. The gas is then employed in a conventional fashion to produce refrigeration as by passage at least through a condenser 118, an expansion device 120 and an evaporator 122, prior to being returned to suction inlet 30 through suction screen 124 of compressor portion 12.

The integral slide valve-oil separator of the present invention minimizes structure and weight within a screw compressor assembly while minimizing pressure drop in the gas produced by the compressor and allows for a compact screw compressor installation. It will be appreciated that there are many modifications, particularly structural, which can be made to the invention taught herein which are within the scope of the invention. As such, the subject invention is to be limited only in accordance with the claims which follow.

What is claimed is:

1. Apparatus for varying the capacity of a compressor assembly in a refrigeration system comprising:

an oil-injected compressor portion defining a discharge port;

an oil separator portion in flow communication with said compressor portion discharge port, said separator portion including a pressure housing; and a slide valve assembly including a valve portion connected to a piston, said piston being disposed for movement within said pressure housing of said oil separator portion and cooperating with said pressure housing to define a pressure chamber, said valve portion being positionable in said compressor portion between a position in which said compressor portion is loaded and a position in which said compressor portion is unloaded, movement of said piston in said pressure housing correspondingly positioning said valve portion in said compressor portion.

2. The apparatus according to claim 1 further comprising means for selectively communicating a pressure fluid to and for venting a pressure fluid from said pressure chamber to move said piston within said pressure cylinder.

3. The apparatus according to claim 2 wherein said oil separator portion includes a permeable outer housing and wherein said pressure housing is disposed interior of said oermeable outer housing.

4. The apparatus according to claim 3 wherein said oil separator portion includes a sealed oil sump housing disposed around said permeable outer housing, oil separated within said oil separator portion from the refrigerant gas-oil mixture discharged from said compressor portion passing through said permeable outer housing and into said sealed oil sump housing, said separated oil being the pressure fluid selectively communicated into and vented from said pressure cylinder to move said piston.

5. The apparatus according to claim 4 wherein said compressor portion defines a suction area including a suction port and wherein said oil vented from said pressure cylinder in said oil separator is vented to said suction area in said compressor.

6. The apparatus according to claim 4 wherein one face of said piston is exposed to compressor discharge pressure within said separator portion and wherein said slide valve assembly is biased by compressor discharge pressure to position said valve portion so that said compressor portion is unloaded.

7. The apparatus according to claim 4 wherein said piston and said valve portion are connected by a rod, said connecting rod penetrating said discharge port of said compressor.

8. The apparatus according to claim 4 wherein said permeable outer housing is cylindrical and wherein a helical ramp is disposed around said pressure housing, the outer edge of said helical ramp juxtaposed the inner surface of said permeable outer housing.

9. The apparatus according to claim 4 further comprising a bearing housing disposed between said permeable outer housing and said discharge port in said compressor portion, said bearing housing defining a discharge passage between said compressor discharge port and the interior of said permeable outer housing.

10. The appartus according to claim 9 wherein said slide valve assembly connecting rod passes through said passage in said bearing housing.

11. Integral oil separator and slide valve apparatus in a screw compressor assembly, where the compressor assembly includes a screw rotor housing defining a discharge port in flow communication with a working chamber in which screw rotors are meshingly disposed, comprising:

a valve portion disposed in said rotor housing;

an oil separator portion in flow communication with said discharge port and including a pressure housing;

a piston disposed for movement within said pressure housing; and means for connecting said slide valve portion in said rotor housing with said piston in said pressure housing of said oil separator portion so that movement of said piston in said pressure housing in said oil separator portion causes corresponding movement of said slide valve portion in said rotor housing.

12. The apparatus according to claim 11 wherein said oil separator portion includes a centrifugal oil separator disposed within an oil sump housing, oil separated within said centrifugal separator being deposited in said oil sump housing, said apparatus further comprising means for communicating oil from said oil sump housing into said pressure housing.

13. The apparatus according to claim 12 wherein said rotor housing includes a suction portion, and further comprising means for venting oil from said pressure housing to said suction portion of said rotor housing.

14. The apparatus according to claim 13 wherein said centrifugal oil separator includes a permeable outer housing in which said pressure housing is disposed, the interior of said permeable housing being in flow communication with said discharge port and said permeable housing cooperating with said pressure housing to define a helical passage within said permeable housing exterior of said pressure housing.

15. A screw compressor assembly comprising:

a compressor portion including a suction portion and a discharge port, said compressor portion defining a working chamber in flow communication with said discharge port;

an oil separator portion having an inlet, said inlet in flow communication with said discharge port of said compressor portion and said separator portion including a pressure housing; and a slide valve assembly including a valve portion connected to a piston, said piston being disposed for movement in said pressure housing within said oil separator portion whereby the movement of said piston causes movement of said valve portion.

16. The compressor assembly according to claim 15 further comprising means for hydraulically moving said piston in said pressure housing by admitting pressure fluid to and venting pressure fluid from said pressure housing.

17. The compressor assembly according to claim 16 wherein the supply of pressure fluid for said means for hydraulically moving said piston is oil separated within said oil separator portion and wherein pressure fluid vented from said pressure housing is vented to said suction portion of said compressor portion.

18. The compressor assembly according to claim 17 wherein said valve portion is movable within said compressor portion between a position in which said compressor assembly is fully loaded and a position in which said compressor assembly is unloaded, admission of said pressure fluid to said pressure chamber moving said piston in said oil separator portion so that said valve portion is caused to move toward said loaded position in said compressor portion and venting of said pressure fluid from said pressure chamber causing said piston to move in said separator portion so that said valve portion is caused to move toward said unloaded position in said compressor portion, said piston being hydraulically locked in position in said pressure housing when pressure fluid is not being admitted to or vented from said pressure housing.

19. The compressor assembly according to claim 18 wherein one face of said piston is exposed to compressor discharge pressure and said slide valve assembly is biased to unload said compressor portion under the influence of compressor discharge pressure.

20. The compressor assembly according to claim 19 wherein said oil separator portion includes a sealed housing and a centrifugal oil separator element interior of said sealed housing, said pressure housing being disposed interior of said separator element.

* * * * *